US007740033B2

(12) United States Patent
Peterson et al.

(10) Patent No.: US 7,740,033 B2
(45) Date of Patent: Jun. 22, 2010

(54) DEBRIS SPLITTING GRINDER

(75) Inventors: Arnold N. Peterson, Eugene, OR (US); Chad Sageser, Eugene, OR (US)

(73) Assignee: Peterson Pacific Corporation, Eugene, OR (US)

( * ) Notice: Subject to any disclaimer, the term of this patent is extended or adjusted under 35 U.S.C. 154(b) by 269 days.

(21) Appl. No.: 11/871,811

(22) Filed: Oct. 12, 2007

(65) Prior Publication Data

US 2008/0087356 A1 Apr. 17, 2008

Related U.S. Application Data

(60) Provisional application No. 60/829,655, filed on Oct. 16, 2006.

(51) Int. Cl.
*B27L 7/00* (2006.01)

(52) U.S. Cl. ..... 144/4.6; 144/193.2; 144/195.8

(58) Field of Classification Search ..... 144/193.1, 144/193.2, 195.8, 195.1, 162.1, 163, 172, 144/2.1, 3.1, 4.6, 195.7
See application file for complete search history.

(56) References Cited

U.S. PATENT DOCUMENTS

| | | | |
|---|---|---|---|
| 0,953,162 | A | 3/1910 | Weinbebgr |
| 1,319,656 | A | 10/1919 | Merwin |
| 3,670,789 | A | 6/1972 | Levin et al. |
| 3,993,113 | A | 11/1976 | Thackery |
| 4,026,337 | A | 5/1977 | Thackery |
| 4,027,709 | A | 6/1977 | Thackery |
| 4,091,851 | A | 5/1978 | Ober |
| 4,132,255 | A | 1/1979 | Thackery |
| 4,188,984 | A | 2/1980 | Lyall |
| 4,211,265 | A | 7/1980 | Thackery |
| 4,245,683 | A | 1/1981 | Cedergren |
| 4,252,166 | A | 2/1981 | Kozicki |
| 4,301,847 | A | 11/1981 | Stickler |
| 4,315,534 | A | 2/1982 | Blackstone |
| 4,335,762 | A | 6/1982 | Reaume et al. |
| 4,347,881 | A | 9/1982 | Wickham et al. |
| 4,403,635 | A | 9/1983 | York |
| 4,418,731 | A | 12/1983 | Smith et al. |
| 4,480,666 | A | 11/1984 | Milosh et al. |
| 4,491,164 | A | 1/1985 | Waikas et al. |
| 4,646,800 | A | 3/1987 | Wentzell |
| 5,142,779 | A | 9/1992 | LaBounty |

(Continued)

FOREIGN PATENT DOCUMENTS

| | | |
|---|---|---|
| DE | 1932387 | 2/1966 |

(Continued)

*Primary Examiner*—Shelley Self
(74) *Attorney, Agent, or Firm*—Schwabe, Williamson & Wyatt

(57) ABSTRACT

Embodiments of the invention provide an apparatus which includes an apparatus body, a splitter for splitter relatively larger pieces of material into relatively smaller pieces of material coupled with the apparatus body, and a grinder for grinding the relatively smaller pieces of material also coupled with the apparatus body. A power source may be adapted to provide power to both the grinder and the splitter. The grinding can be accomplished with minimal repositioning of the relatively smaller pieces once split. The splitting, then the grinding can be accomplished with little to no translational movement within a job site of a nearby piece of equipment adapted for picking up first the relatively larger pieces then the relatively smaller pieces.

7 Claims, 4 Drawing Sheets

U.S. PATENT DOCUMENTS

| | | | | |
|---|---|---|---|---|
| 5,320,149 | A * | 6/1994 | Peterson et al. | 144/4.1 |
| 5,713,525 | A | 2/1998 | Morey | |
| 5,836,528 | A * | 11/1998 | Hilgarth | 241/93 |
| 5,921,302 | A * | 7/1999 | Petersen | 144/334 |
| 6,705,364 | B2 | 3/2004 | Ellison | |

FOREIGN PATENT DOCUMENTS

| | | |
|---|---|---|
| EP | 1393870 | 3/2004 |
| GB | 2073656 | 10/1981 |

* cited by examiner

DEBRIS SPLITTING GRINDER

CROSS-REFERENCE TO RELATED APPLICATIONS

The present application claims priority to U.S. Provisional Patent Application No. 60/829,655, filed Oct. 16, 2006, entitled "DEBRIS SPLITTING GRINDER," the entire disclosure of which is hereby incorporated by reference in its entirety.

TECHNICAL FIELD

Embodiments of the invention pertain to recyclers/grinders adapted to size reduce debris and various materials, and in particular to grinder having an initial debris splitting component that can size reduce stumps and other debris prior to further size reduction in the grinder, such as by grinding.

BACKGROUND

Debris, such as construction debris, wood and/or other organic or inorganic materials are often ground in a large recyclers/grinder machines in order to size reduce the debris into useful uniform smaller particles. Oftentimes, however, a piece of debris will be encountered that is too large or shaped such that it cannot be fed through a horizontal grinder without an initial reduction. For example, in the case of clearing trees from land, some of the more difficult materials to reduce are the tree stumps, roots and/or the large butt end of the tree. While these objects may be able to be handled by a tub grinder, they can be too large to pass through most types of horizontal grinders.

Currently, jaw- or scissor-type shearing devices are used with recyclers to break down large objects before feeding them into a horizontal grinder. These shearing devices are typically mounted on a backhoe or excavator arm and are operated with the aid of the machine's hydraulics. These shearing implements, however, require the use of a second machine or limit the usefulness of the machine with the shearing attachment for feeding material to the horizontal grinder.

DRAWINGS

Embodiments of the present invention will be readily understood by the written description along with reference to the accompanying drawings and photographs. Embodiments of the invention are illustrated by way of example and not by way of limitation in the accompanying pictures and/or figures.

Figure 4A:
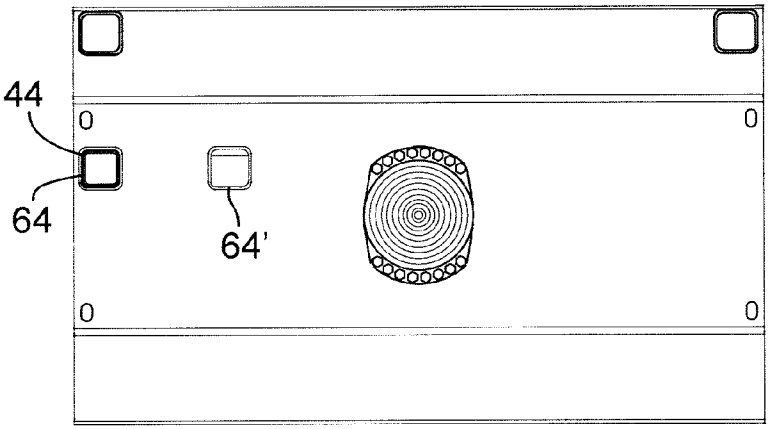
Figure 4B:
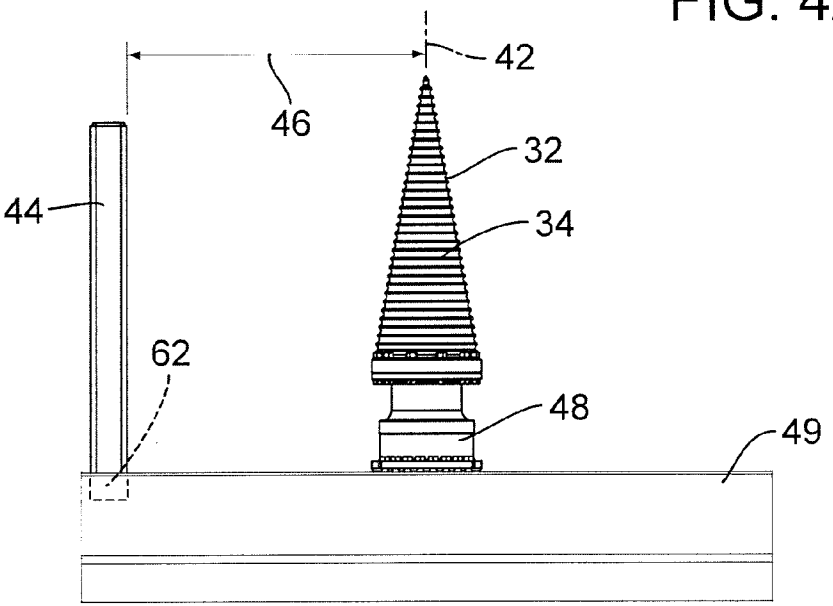
Figure 4C:
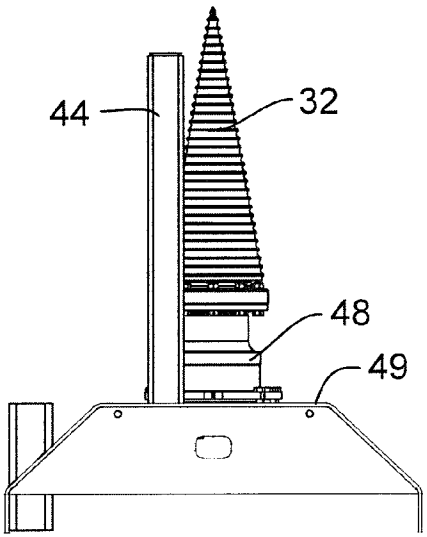

FIGS. 4A, 4B, and 4C illustrate respective top, front and side views of a portion of various embodiments of the present invention;

DETAILED DESCRIPTION OF EMBODIMENTS OF THE INVENTION

In the following detailed description, reference is made to the accompanying drawings which form a part hereof wherein like numerals designate like parts throughout, and in which is shown by way of illustration embodiments in which the invention may be practiced. It is to be understood that other embodiments may be utilized and structural or logical changes may be made without departing from the scope of the present invention. Therefore, the following detailed description is not to be taken in a limiting sense, and the scope of embodiments in accordance with the present invention is defined by the appended claims and their equivalents.

Various operations may be described as multiple discrete operations in turn, in a manner that may be helpful in understanding embodiments of the present invention; however, the order of description should not be construed to imply that these operations are order dependent.

The description may use perspective-based descriptions such as up/down, back/front, and top/bottom. Such descriptions are merely used to facilitate the discussion and are not intended to restrict the application of embodiments of the present invention.

For the purposes of the present invention, the phrase "A/B" means A or B. For the purposes of the present invention, the phrase "A and/or B" means "(A), (B), or (A and B)." For the purposes of the present invention, the phrase "at least one of A, B, and C" means "(A), (B), (C), (A and B), (A and C), (B and C), or (A, B and C)." For the purposes of the present invention, the phrase "(A)B" means "(B) or (AB)," that is, A is an optional element.

The terms "coupled" and "connected," along with their derivatives, may be used. It should be understood that these terms are not intended as synonyms for each other. Rather, in particular embodiments, "connected" may be used to indicate that two or more elements are in direct physical or electrical contact with each other. "Coupled" may mean that two or more elements are in direct physical or electrical contact. However, "coupled" may also mean that two or more elements are not in direct contact with each other, but yet still cooperate or interact with each other.

The description may use the phrases "in an embodiment," or "in embodiments," which may each refer to one or more of the same or different embodiments. Furthermore, the terms "comprising," "including," "having," and the like, as used with respect to embodiments of the present invention, are synonymous.

Embodiments of the present invention may include a horizontal grinder, such as a wood and other debris-type grinders that may include an initial stage debris splitting assembly for reducing the size of stumps and other debris that may not ordinarily be able to be fed into the horizontal grinder. In various embodiments, a rotating conical screw may be coupled to the horizontal grinder and adapted to split debris prior to feeding such debris into the horizontal grinder. Embodiments of the present invention may eliminate the need for a shearing device thus either eliminate the need for the second machine (e.g. backhoe or excavator) or assuring that the primary backhoe or excavator feeding machine is not encumbered with a shearing implement.

Figure 1:
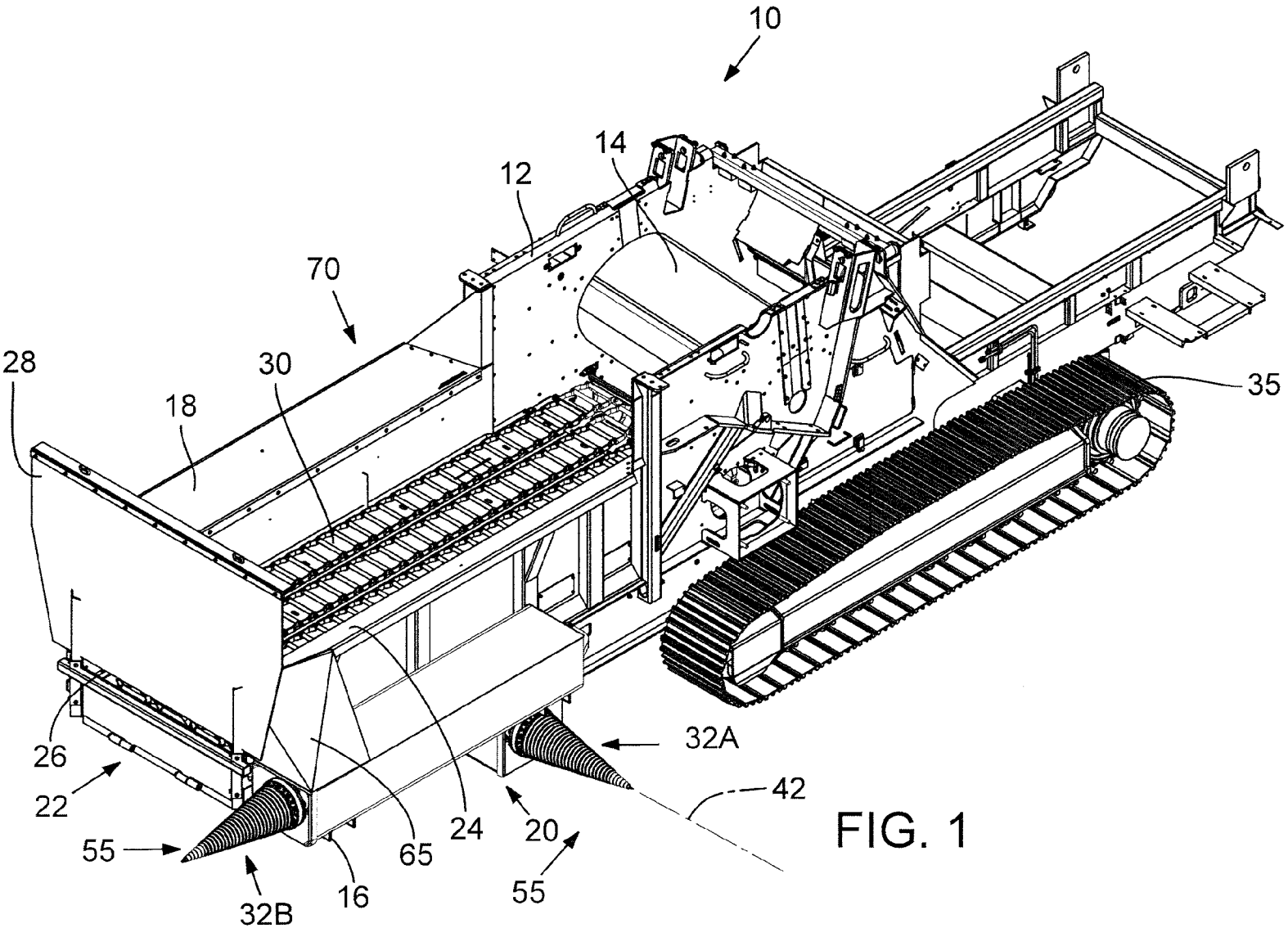
FIG. 1 illustrates a perspective view in accordance with various embodiments of the present invention.

FIG. 1 is a perspective view illustrating various embodiments in accordance with the invention. An apparatus 10, such as a horizontal grinder 10 may include an apparatus body, or a frame 12 that may be adapted to be positioned in an environment with material, for example, logs and/or stumps of trees to be ground into smaller pieces. A reducing mechanism, such as a grinding rotor 14, may be operatively supported by the frame 12. The grinding rotor 14 may be a horizontally mounted cylinder having material reducing elements disposed on an annular surface thereof. The horizontal grinder 10 may have a power source adapted operate the grinding rotor 14.

The apparatus 10 may include a hopper 18 that may be adapted to receive the material to be ground. The material may be loaded into the hopper 18 from a nearby piece of equipment (not shown), for example, an excavator, or back-hoe, or the like. The material may be loaded from a first side 20 into the hopper or a first end 22. The first side 20 may include a side opening 24. The first end 22 may include an end opening 26 that may include a door 28 that may be removed to provide end access to the hopper 18. A transport arrangement in the form of an in-feed chain 30, endless belt, or the like, may be provided at a bottom of the hopper 18 to transport the material to the drum rotor 14.

Some of the material may be too big to fit into the hopper 18 and/or be easily processed by the grinding rotor 14, or otherwise be cumbersome to be processed by the drum rotor 14. Grinder 10 may include a splitter assembly 32A and/or 32B, or generally splitter assembly 32, which may be adapted for splitting relatively larger pieces of material into relatively smaller pieces of material. In some embodiments the splitter assembly 32 may be securely coupled with, or made integral with, the frame 12, as illustrated in FIG. 1, which in some cases may allow for repair and/or replacement. Various other coupling arrangements may be effected with other embodiments. After the splitter assembly 32 splits the relatively larger pieces of material the grinding rotor 14 may grind the relatively smaller pieces of material into even smaller end product pieces.

Figure 2:
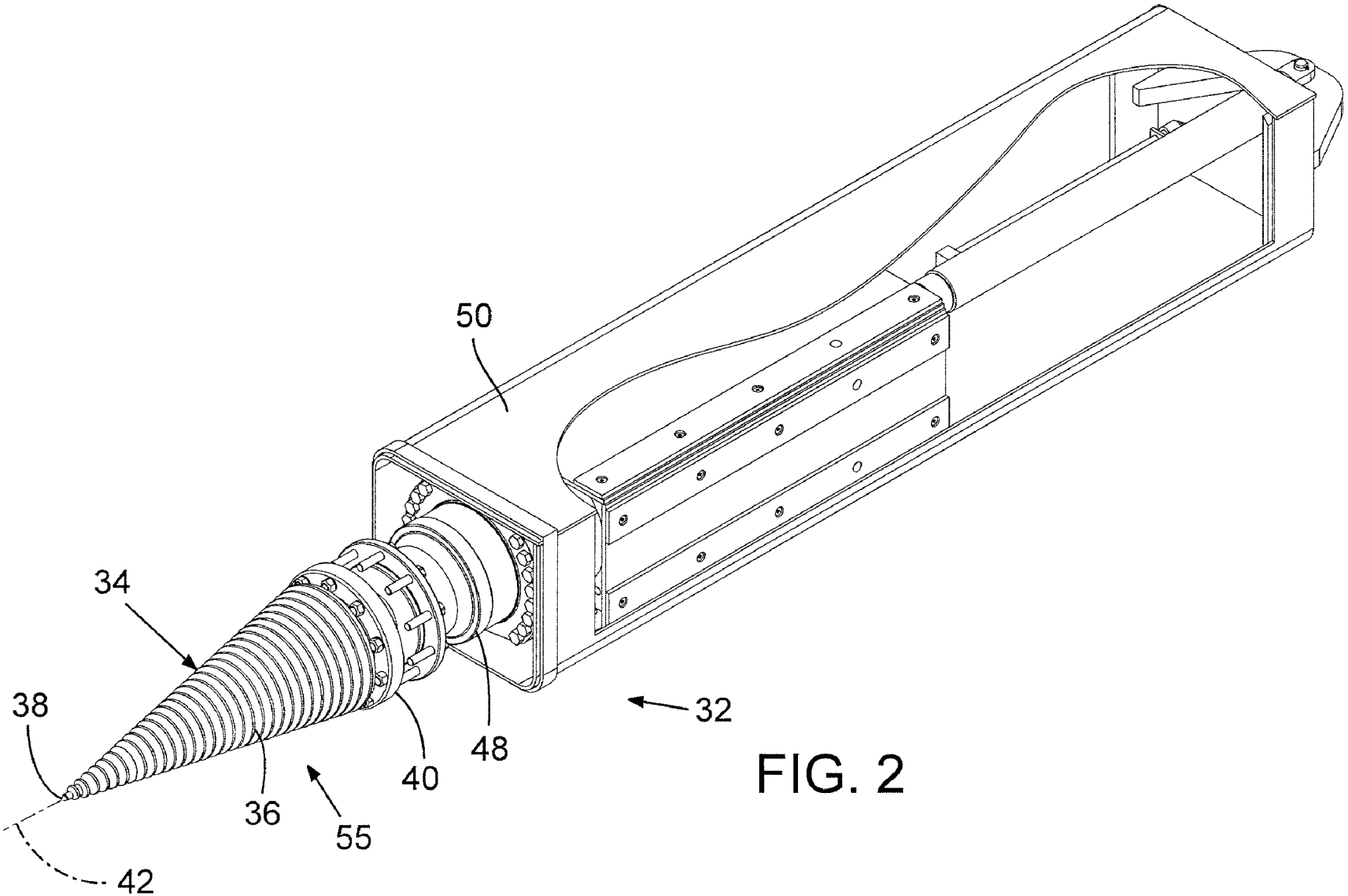
FIG. 2 illustrates a partial perspective view of various embodiments of the present invention.

FIG. 2 is a perspective view illustrating a portion of various embodiments of a splitter assembly 32 in accordance with various embodiments. The splitter assembly 32 may have a conical-shaped splitter body 34 and may have a spiral thread 36 extending from an apex 38 of the splitter body 34 toward a base 40 of the splitter body 34. The splitter body 34 may affect splitting of the relatively larger pieces of material by rotating about a central axis 42 and screwing the spiral thread 36 into the relatively larger pieces. In various embodiments, the threads 36 may be of a variety of pitches and/or with multiple leads, and the taper of the splitter body 34 may be varied, both depending on a variety of factors, such as the desired aggressiveness of the splitting action and the capability of the system that powers the splitter mechanism. In various embodiments, for example, the pitch may be in the range of about ¾ of an inch to 1¼ inches, and the taper of the splitter body 34 may be in the range of 5 to 20 degrees.

In various embodiments, the splitter assembly 32 may include a driver 48 coupled to the cone-shaped splitter body 34 and adapted to cause the splitter body 34 to rotate at a desired rate. In various embodiments, the driver 48 may be a hydraulic motor, electric motor, or a mechanical power transfer mechanism. In various embodiments, the driver 48 may be operated by a hydraulic circuit that is coupled to the hydraulics of the grinder, or it may operated by a dedicated circuit from a separate hydraulic drive source. In such embodiments, the hydraulic circuit may cause rotation of the conical splitter body 34. The driver 48 may receive power from the primary power source for the grinder 10, which may be for example, an electric motor, an electric generator, or internal combustion engine, or the like. In various embodiments, the primary power source may also be adapted to provide locomotive power to the apparatus 10 via wheels or tracks or the like. FIG. 1 illustrates the apparatus 10 having tracks 35.

In various embodiments, the driver 48 may be operated by a circuit that includes an impact capability, such as a pulsation system. An impact capability may help cause the head to rotate with an impacting or hammering action. The impact circuit may help increase the effectiveness of the assembly in splitting the debris (particularly in the case of, for example, hard woods such as oak or other hardwoods, as well as in some cases hard debris such as concrete).

In various embodiments, the driver 48 may be adapted for multi-speed and/or multi-torque operation. For example, the driver 48 may be able to drive the splitter body 34 at a higher rate of speed, but at a lower torque, which may be advantageous for relatively easy to split debris. In another embodiment, the driver 48 may be adapted to drive the splitter body 34 at lower speeds, but at a higher torque in order to split the harder to split debris. In various embodiments, different speed/torque combinations may be selected by the operator.

The splitter assembly 32 may be coupled with the grinder frame 12 such that it may have an operating position 55 (as shown in FIGS. 1 and 2), wherein the apex 38 of the conical-shaped splitter body 34 is accessibly disposed to be screwed into the relatively larger pieces of material, and a storage position wherein the splitter is relatively closer to the apparatus body and/or disposed with in a splitter housing 50. In various embodiments, the splitter head 34 may be moved from the operational position to the storage positions in a variety of ways. For example, a hydraulic cylinder may be disposed within the housing 50 and coupled to the driver 48. Extension and retraction of the hydraulic cylinder may cause movement from the operational to the storage position.

Figure 3:
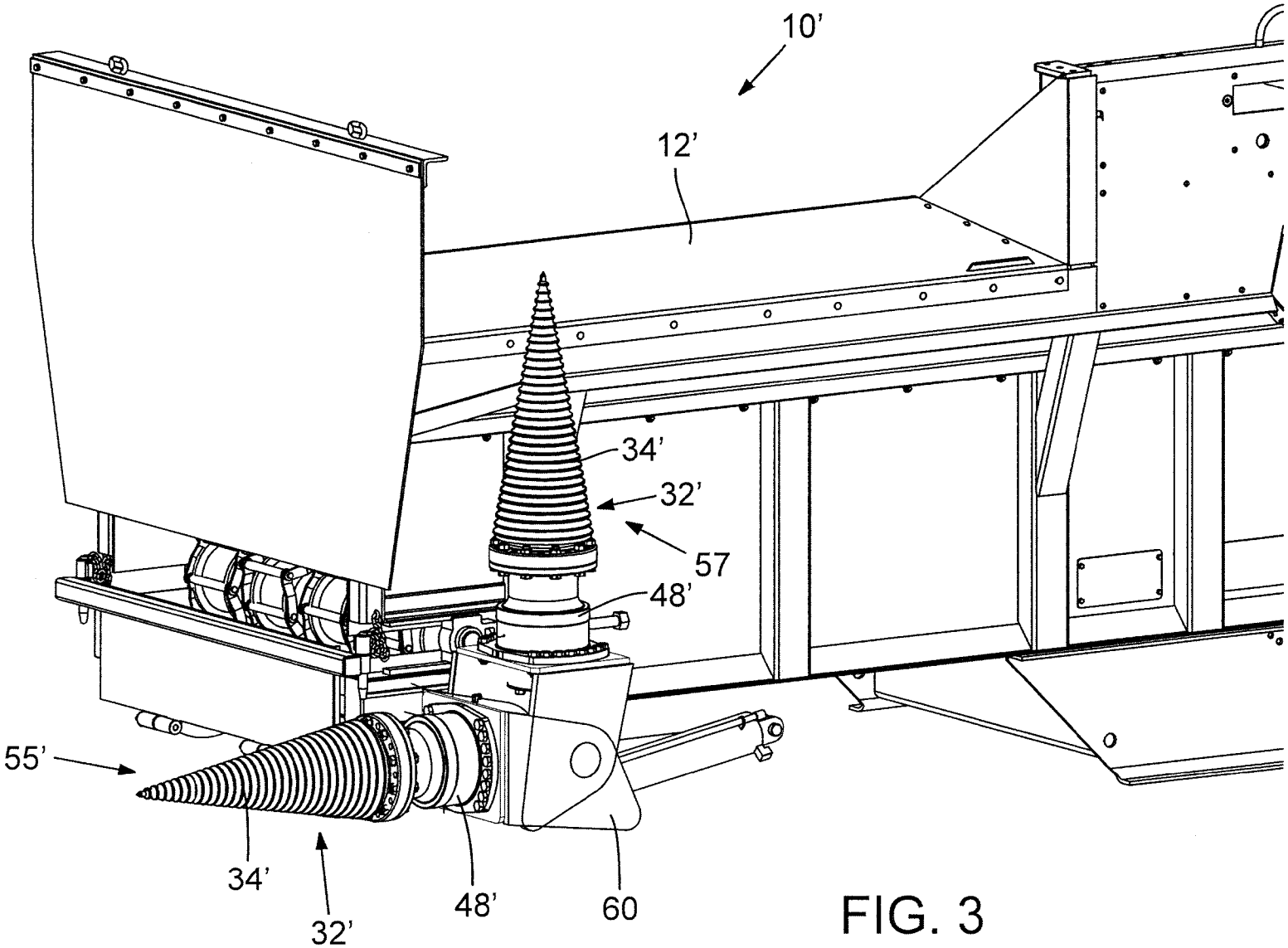
FIG. 3 illustrates a partial perspective view of various embodiments of the present invention.

FIG. 3 illustrates another example embodiment of a splitter assembly having a splitter head 34 with both an operational and storage position. A splitter assembly 32' may include a splitter body 34' coupled to a driver 48' that is mounted on a pivotal frame 60 coupled to frame 12'. Splitter body 34' and driver 48' can be selectively pivoted from a storage position 57 to an operating position 55' by pivoting the pivotal frame 60. In various embodiments a single power source may be adapted to pivot the pivotal frame 60 from the storage position 57 to the operating position 55', as well as actuate driver 48'.

In various embodiments, control of the splitter assembly components (e.g. extension and retraction, rotation, etc of the head) may be via a manual interface at or near the splitter assembly, or in other embodiments, such control may be via a wireless control by an operator. Further, in various embodiments, the splitter assembly may be removably coupled to the recycler such that an operator may remove the assembly for situations where such debris splitting is not required and/or to facilitate repair.

While splitting, the object imbedded on the conical head will tend to rotate due to its resistance to the wedging action. In various embodiments, an anti-rotation member may be used in order to help resist such rotation. FIGS. 4A, 4B, and 4C, are respectively a front, a top, and side view, illustrating various details of various embodiments in accordance with the invention. A splitter head 34 and driver 48 in accordance with embodiments of the invention may be mounted for rotation on a support 49. Splitter assembly 32 may include an anti-rotation member 44 spaced a distance 46 from the central axis 42 and disposed to help arrest rotation of the relatively larger pieces of material as the splitter body 34 rotates. The anti-rotation member 44 may be coupled to the support 49 by, for example, having one end 62 fixed into a receiver 64 in the support 49. The support 49 may include more than one receiver, for example, two receivers 64 and 64', as illustrated, for enabling adjustable repositioning of the anti-rotation member 44.

In various embodiments, the anti-rotation member 44 may be in the form of stops, bars, plates and/or other devices. In one embodiment, the ground may act as the anti-rotation member. In various embodiments, the splitter head and/or the driver may be angled towards the ground to facilitate engagement of the debris with the ground.

In various embodiments, two or more cone-shaped splitter bodies may be used in conjunction with each other to penetrate and split the debris. Use of multiple splitter bodies may act as an anti-rotation member in that the object will be generally prevented from rotating due to the multiple penetrations into the object. Use of multiple splitter bodies may also help to confine the torque stresses induced on the structural components, both within the splitting assembly, as well as the coupling structure and the recycler machine itself. The splitter may include two conical-shaped threaded splitter bodies adapted for rotation about respective central axis thereof screwing into the relatively larger pieces of material to effect splitting of the relatively larger pieces of material.

As illustrated in FIG. 1, in various embodiments, angled and/or tapered deflecting members 65 may be coupled to the assembly at a point at or near the splitter body, which may serve to deflect split pieces in desired directions. In some embodiments, the deflecting members may be configured to help facilitate the splitting of the debris by virtue of their positioning and/or their angle/taper. Deflecting members may be of a variety of different configuration and coupled to the splitter assembly in a variety of ways.

Various embodiments include a recycler having: a grinder frame 12. A horizontal grinder rotor 14 may be supported by the frame 12 for grinding material. A receiving location 70, for example the hopper 18, may be coupled with the recycler frame for receiving material to be ground by the horizontal grinder rotor 14. A debris splitting assembly 32 may be coupled with the recycler frame 12 proximal to the receiving location 70 such that relatively larger pieces of material can be split into relatively smaller pieces of material with the debris splitting assembly 32. Then the relatively smaller pieces can be loaded into the receiving location 70 with minimal repositioning of the relatively smaller pieces. A power source may be located on the grinder 10 and may be adapted to provide power to the drum rotor 14 and to the debris splitter 32.

In operation, an operator may urge a piece of debris against the conical-shaped head of the splitter assembly, using for example an excavator or other implement. By virtue of the features of the splitting assembly (e.g. threading, impact action, etc), the head may penetrate into the debris, and force the debris to split apart. Once satisfactorily split, the operator may place the parts into the receiving location and/or use the splitting assembly again to further split the debris.

In some embodiments the grinder 10 may include one, two, or two or more splitters. The embodiment illustrated in FIG. 1 includes two splitters 32A and 32B. A first splitter 32A may be coupled with the apparatus 10 proximal to the side opening 24, and positioned on the apparatus such that a nearby piece of equipment (not shown) in a nearby position, may grab and then position a piece of material to be split by the splitter 32A. Then with relatively little movement, for example with just articulated movement but without substantially moving from the nearby position, the nearby piece of equipment may position the split pieces into the hopper 18 and/or onto the in-feed chain 30 to be transported to the grinder rotor 14. Articulated movement may be defined as: pivoting and/or rotational movement of a boom or an arm, or the like, with an articulated grappler at one end thereof adapted to grab and/or pick up, and let go of, one or more pieces of material. The nearby piece of equipment may include one or more translational features to move the piece of equipment translationally in, and within, a job site. The translational features may be, for example, wheels or tracks. Without substantially moving from the nearby position may be defined as: keeping the piece of equipment substantially stationary at the job site and/or relatively stationary relative to the apparatus 10.

Although certain embodiments have been illustrated and described herein for purposes of description of the preferred embodiment, it will be appreciated by those of ordinary skill in the art that a wide variety of alternate and/or equivalent embodiments or implementations calculated to achieve the same purposes may be substituted for the embodiments shown and described without departing from the scope of the present invention. Those with skill in the art will readily appreciate that embodiments in accordance with the present invention may be implemented in a very wide variety of ways. This application is intended to cover any adaptations or variations of the embodiments discussed herein. Therefore, it is manifestly intended that embodiments in accordance with the present invention be limited only by the claims and the equivalents thereof.

What is claimed is:

1. A material reducing apparatus comprising:

a frame;

a splitter assembly coupled to the frame for reducing the size of objects, the splitter having a generally conical shaped splitter body; the splitter body having one or more spiral threads extending generally from an apex of the conical shape of the splitter body toward a base of the splitter body; and a driver coupled to the splitter body to rotationally drive the splitter body about a central axis;

a horizontal grinder coupled to the frame and adapted to size reduce material including further size reduction of the material split by the splitter assembly; and a housing sized to generally house at least a portion of the splitter body in a storage position and having an opening adapted to enable the splitter body to extend there from into an operating position;

wherein the splitter has an operating position wherein an apex of the conical shaped splitter body is accessibly disposed to be screwed into the material, and a storage position wherein the splitter is not disposed for operation.

2. The apparatus of claim 1 wherein the horizontal grinder includes a grinder rotor and further comprising a power source that provides power to the driver and to the grinder rotor.

3. The apparatus of claim 1 wherein the splitter assembly further comprises an anti-rotation member spaced a distance from the central axis and disposed to help arrest rotation of the material as the splitter body rotates.

4. The apparatus of claim 1 further comprising a pivotal frame pivotally coupled with the splitter body such that the splitter body is selectively pivotable from the storage position to the operating position.

5. The apparatus of claim 1 wherein the splitter includes two conical-shaped threaded splitter bodies adapted for rotation about respective central axes thereof to effect splitting of the relatively larger pieces of material, the two conical-shaped threaded splitter bodies disposed sufficiently close to one another to be screwed into the same piece of material to prevent rotation of the re material while being split.

6. The apparatus of claim 1 wherein the driver has an impact capability to induce an impact action on the splitter body or a variable torque and speed capability to induce respective torque and speed changes on the splitter body.

7. The apparatus of claim 1 further comprising one or more deflecting members coupled to the splitter assembly or frame to help facilitate splitting of the material.

* * * * *